US007114796B2

(12) United States Patent
Silverbrook

(10) Patent No.: US 7,114,796 B2
(45) **Date of Patent: *Oct. 3, 2006**

(54) PRINTHEAD MODULE SUPPORT

(75) Inventor: Kia Silverbrook, Balmain (AU)

(73) Assignee: Silverbrook Research Pty Ltd, Balmain (AU)

( * ) Notice: Subject to any disclaimer, the term of this patent is extended or adjusted under 35 U.S.C. 154(b) by 0 days.

This patent is subject to a terminal disclaimer.

(21) Appl. No.: 11/087,556

(22) Filed: Mar. 24, 2005

(65) Prior Publication Data

US 2005/0162471 A1 Jul. 28, 2005

Related U.S. Application Data

(63) Continuation of application No. 10/913,343, filed on Aug. 9, 2004, which is a continuation of application No. 10/713,078, filed on Nov. 17, 2003, now Pat. No. 6,789,881, which is a continuation of application No. 10/129,433, filed as application No. PCT/AU01/00217 on Mar. 2, 2001, now Pat. No. 6,672,707.

(30) Foreign Application Priority Data

Mar. 2, 2000 (AU) ..... PQ5957

(51) Int. Cl.
*B41J 2/14* (2006.01)

(52) U.S. Cl. ..... 347/49

(58) Field of Classification Search ..... 347/49, 347/37

See application file for complete search history.

(56) References Cited

U.S. PATENT DOCUMENTS

| | | | |
|---|---|---|---|
| 5,016,023 | A | 5/1991 | Chan et al. |
| 5,057,854 | A | 10/1991 | Pond et al. |
| 5,148,194 | A | 9/1992 | Asai et al. |
| 5,160,945 | A | 11/1992 | Drake |
| 5,297,017 | A | 3/1994 | Haselby et al. |
| 5,488,397 | A | 1/1996 | Nguyen et al. |
| 5,850,240 | A | 12/1998 | Kubatzki et al. |
| 6,000,782 | A | 12/1999 | Lee |
| 6,068,367 | A | 5/2000 | Fabbri |
| 6,290,332 | B1 | 9/2001 | Crystal et al. |

FOREIGN PATENT DOCUMENTS

| | | | |
|---|---|---|---|
| EP | 0379151 | A | 7/1990 |
| EP | 0391570 | A | 10/1990 |
| EP | 1000744 | A | 5/2000 |

*Primary Examiner*—Stephen Meier
*Assistant Examiner*—An H. Do

(57) ABSTRACT

The present invention relates to a support for supporting a plurality of printhead modules for a printhead. The support comprises an elongate chassis and a plurality of printhead module engagement arrangements located along the length of the chassis. Each printhead module engagement arrangement is suitable for engaging with a respective printhead module. There is also provided a plurality of movement arrangements for each moving a respective engagement arrangement along the length of the chassis. The present invention also relates to a printhead comprising the support.

6 Claims, 7 Drawing Sheets

PRINTHEAD MODULE SUPPORT

CROSS REFERENCE TO RELATED APPLICATIONS

The present application is a Continuation of U.S. application Ser. No. 10/913,343 filed Aug. 9, 2004, which is a Continuation of Ser. No. 10/713,078 filed Nov. 17, 2003, now issued U.S. Pat. No. 6,789,881, which is a Continuation of Ser. No. 10/129,433 filed May 6, 2002, now issued U.S. Pat. No. 6,672,707, which is a 371 of PCT/AU01/00217 filed Mar. 2, 2001, the entire contents of which are herein incorporated by reference.

FIELD OF THE INVENTION

The present invention relates to inkjet printers and in particular to pagewidth inkjet printers. More particularly, this invention relates to a modular printhead assembly with manually adjustable printhead modules.

CO-PENDING APPLICATIONS

Various methods, systems and apparatus relating to the present invention are disclosed in the following co-pending applications filed by the applicant or assignee of the present invention on 24 May 2000:

| | | | |
|---|---|---|---|
| PCT/AU00/00578 | PCT/AU00/00579 | PCT/AU00/00581 | PCT/AU00/00580 |
| PCT/AU00/00582 | PCT/AU00/00587 | PCT/AU00/00588 | PCT/AU00/00589 |
| PCT/AU00/00583 | PCT/AU00/00593 | PCT/AU00/00590 | PCT/AU00/00591 |
| PCT/AU00/00592 | PCT/AU00/00584 | PCT/AU00/00585 | PCT/AU00/00586 |
| PCT/AU00/00594 | PCT/AU00/00595 | PCT/AU00/00596 | PCT/AU00/00597 |
| PCT/AU00/00598 | PCT/AU00/00516 | PCT/AU00/00517 | PCT/AU00/00511 |

The disclosures of these co-pending applications are incorporated herein by cross-reference. Also incorporated by cross-reference, is the disclosure of a co-filed PCT application, PCT/AU01/00216 (deriving priority from Australian Provisional Patent Application No. PQ5959).

BACKGROUND OF THE INVENTION

The printheads used by inkjet printers traditionally traverse back and forth within the printer as a page is fed past the printhead. To increase printing speed, pagewidth printheads have been developed so that the printhead does not need to traverse across the page.

For a number of reasons, it is relatively expensive to produce pagewidth printheads in a unitary form. Therefore, to minimize costs it is preferable to produce a modular pagewidth printhead made up of a series of printhead modules.

It is necessary to align each module so that the printing from one module precisely abuts the printing from the adjacent modules. For most types of printing, it is sufficient to electronically align the modules. This is done by configuring the modules such that they slightly overlap with each other, and then digitally adjusting the printing from each module for a smooth transition of the print data.

Unfortunately, this requires complex manipulation of the print data allocated to the respective modules. The digital controller for the printer needs to be relatively powerful to accommodate this and the associated costs can be prohibitive for the SOHO (small office/home office) market.

SUMMARY OF THE INVENTION

According to a first aspect of the invention, there is provided a modular printhead assembly for a digital printer, the printhead assembly including:

an elongate support frame;

a plurality of mounting members positioned on the support frame to extend along the support frame;

an adjustment mechanism that is positioned on each mounting member to engage the support frame thereby to permit positional adjustment of each mounting member relative to the support frame; and a plurality of printhead modules that are mounted on respective mounting members, such that operation of the adjustment mechanisms results in displacement of the printhead modules relative to the support frame.

The support frame may be an elongate metal chassis.

Each mounting member may be a mounting plate that is integrally formed with the metal chassis, the chassis and the mounting plate being configured so that relative movement of the chassis and the mounting plate is substantially constrained to be along a longitudinal axis of the chassis.

Each adjustment mechanism may include an input lever fulcrumed against the support frame for acting on the respective mounting plate and a bearing arrangement that is displaceable relative to the support frame and accessible by an operator, such that displacement of the bearing arrangement by the operator results in displacement of the respective input lever.

Each bearing arrangement may include an adjustment screw that is threadedly engaged with the chassis and an adjuster block interposed between the adjustment screw and the respective input lever.

A linkage formation may be interposed between the input lever and the mounting plate. The linkage formation may be configured so that displacement of the bearing arrangement occurs in a direction substantially orthogonal to a direction of displacement of the mounting plate.

Accordingly, the present invention provides a modular printhead for a digital printer, the modular printhead including:

a support frame and a plurality of printhead modules, the frame having a plurality of mounting sites for mounting respective printhead modules to the frame; wherein, at least one of the mounting sites has an adjustment mechanism for reducing input movements to effect minute adjustments of the position of the printhead module with respect to the frame.

Preferably, the adjustment mechanism uses a system of levers and pivots for geared reduction of the input movements to minute adjustments of the printhead module relative to the frame. In a further preferred form, the ratio of input movement to the resultant adjustment is at least 500 to 1.

In a particularly preferred form, the movement of the printhead module relative to the frame is less than 100 μm.

In some embodiments, the adjustment mechanism includes an input lever fulcrumed against the support frame for acting on a module engagement plate, the module engagement plate being connected to the support frame by hinged link arms such that the resultant movement of the plate is substantially linear. Preferably, the movement of the input lever is substantially normal to the resultant movement of the engagement plate. In a further preferred form, the input lever for each of the adjustment mechanisms is actuated by a respective grub screw threadedly engaged with the support frame. Conveniently, the ratio of axial movement of the grub screw to the movement of the plate is about 1000 to 1.

Conveniently, the adjustment mechanism is integrally formed with the frame wherein the fulcrum and hinged connections are formed by localized necks in the frame material.

BRIEF DESCRIPTION OF THE DRAWINGS

A preferred embodiment of the invention will now be described by way of example only with reference to the accompanying drawings in which.

DETAILED DESCRIPTION OF THE PREFERRED EMBODIMENTS

Figure 1:
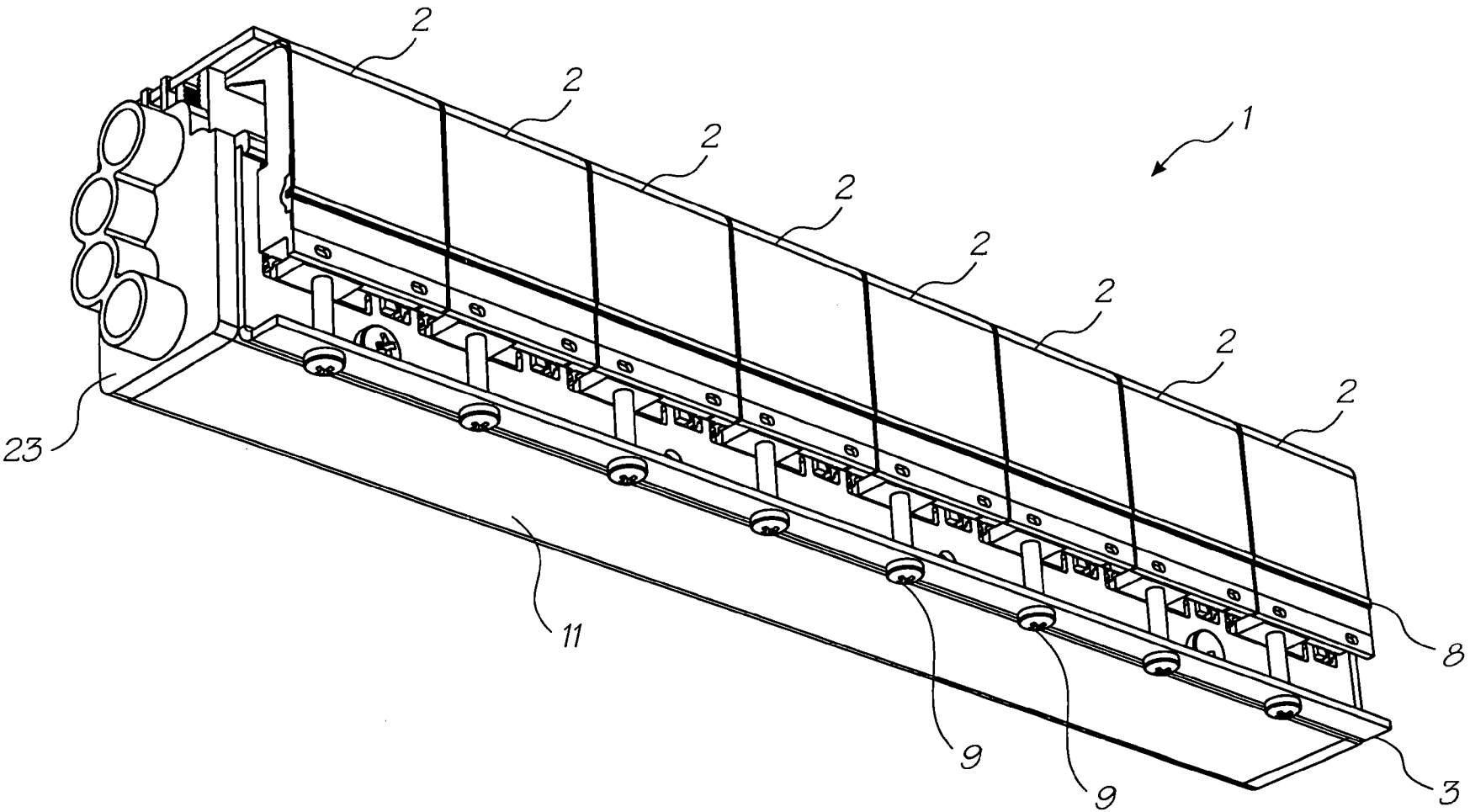
FIG. 1 shows a perspective view of the underside of a modular printhead according to the present invention.
Figure 2:
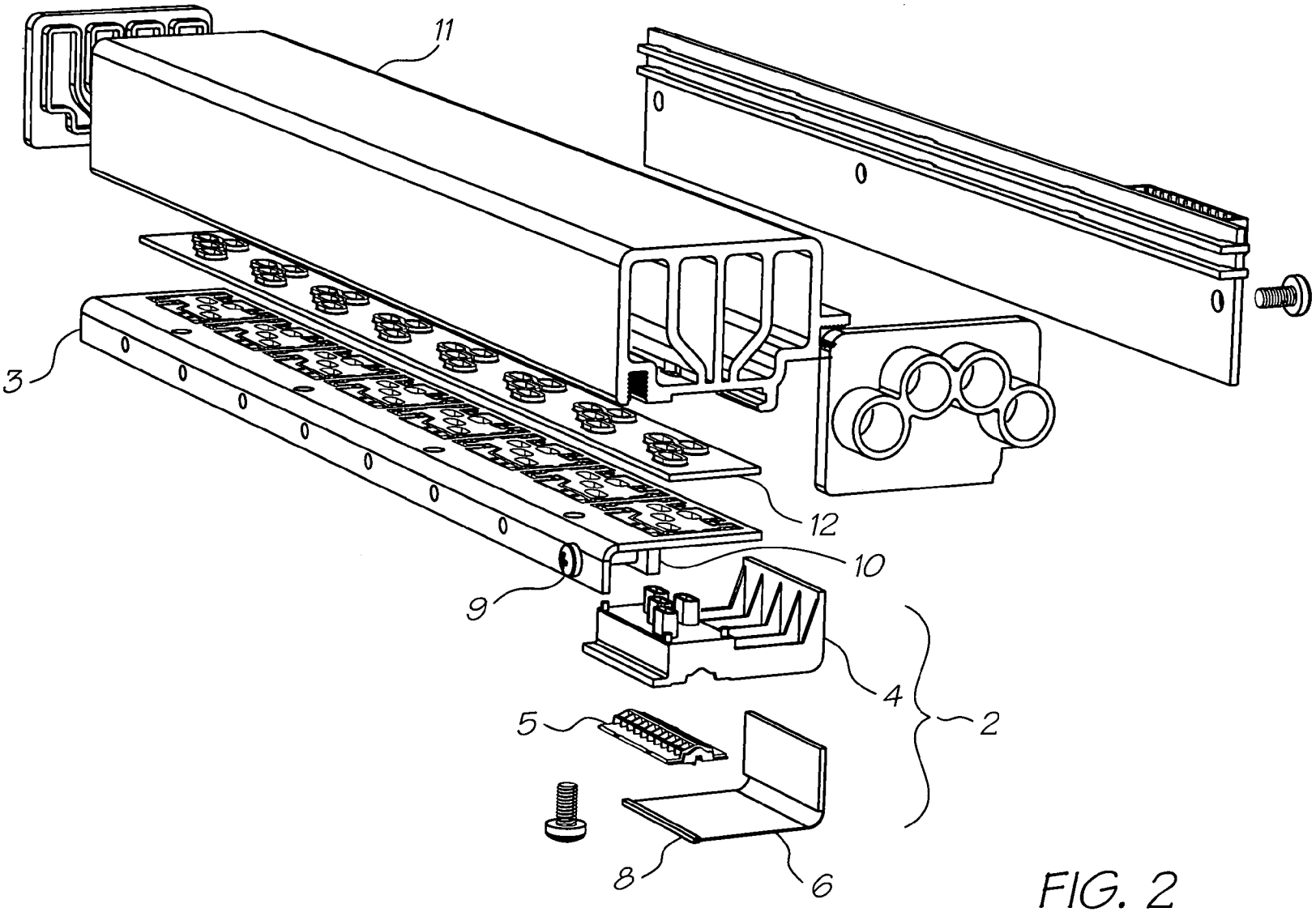
FIG. 2 shows an exploded perspective view of the modular printhead shown in FIG. 1.

Referring to the figures, the modular printhead (1) includes a plurality of printhead modules (2) mounted to a metal chassis (3) which acts as a support frame. The modules (2) are sealed units with four independent ink chambers that feed the inkjet nozzles in a printhead chip (8). As best seen in FIG. 2, each printhead module (2) is plugged into a reservoir moulding (11) that supplies the ink through a self sealing elastomeric strip (12). The entire modular printhead (1) may itself be a module of a larger printhead having two levels of modularity. Accordingly, the length of the overall printhead is arbitrary.

Figure 7:
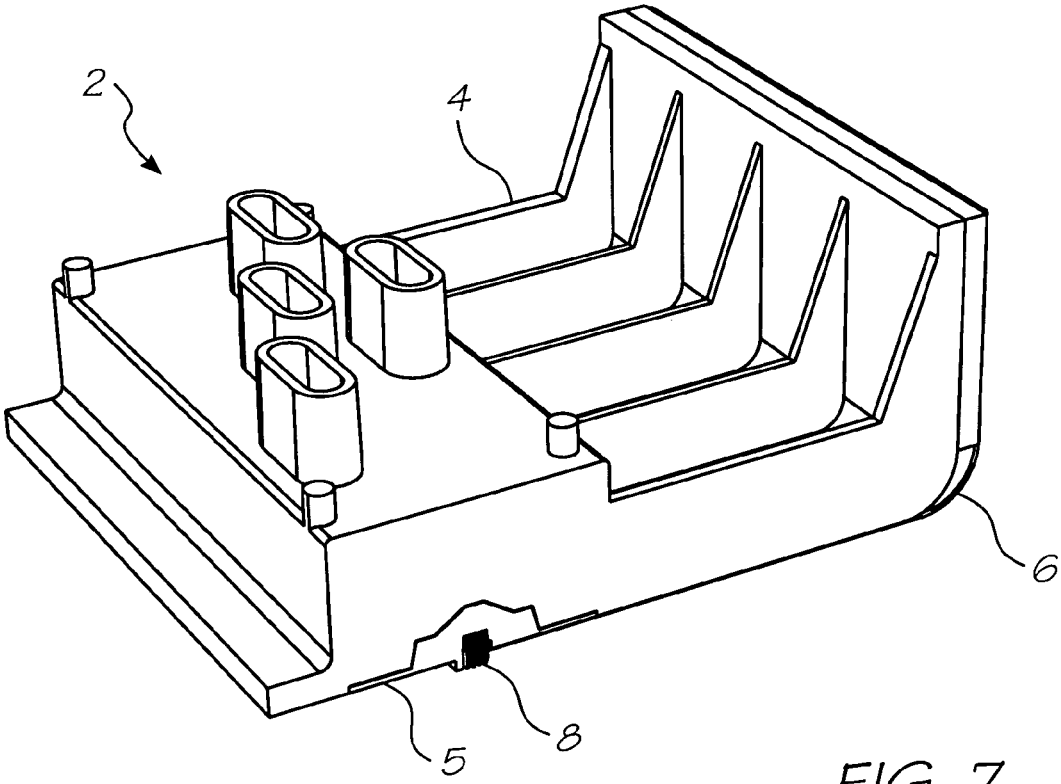
FIG. 7 is a perspective view showing the top and side of a printhead module.
Figure 8:
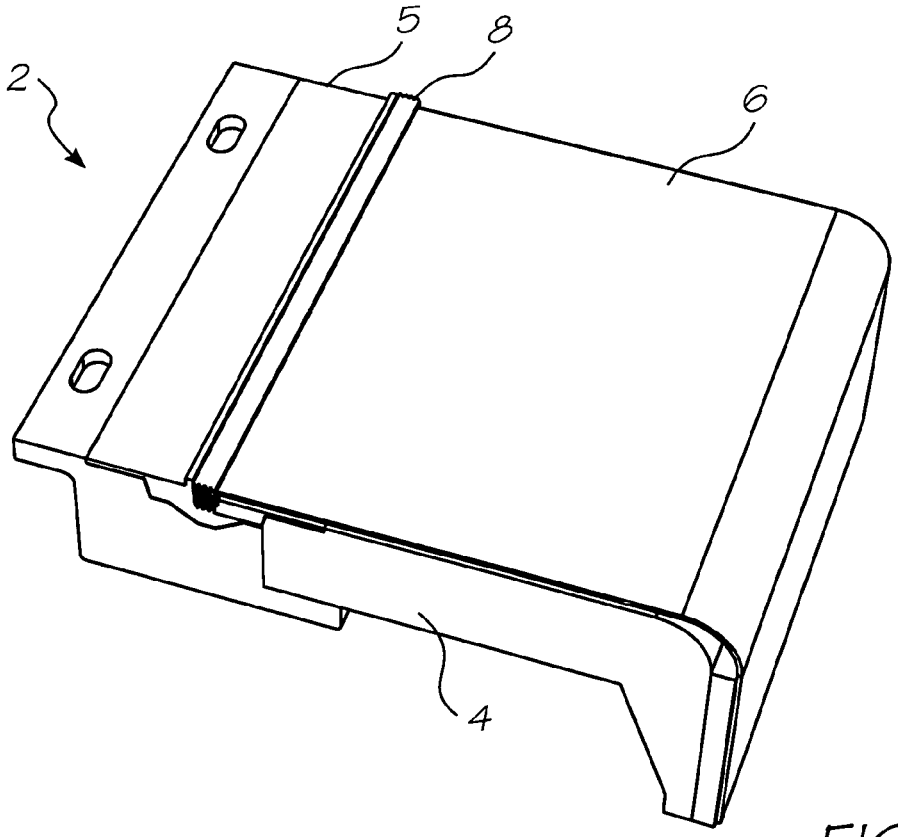
FIG. 8 is a perspective view showing the underside of a printhead module.
Figure 9:
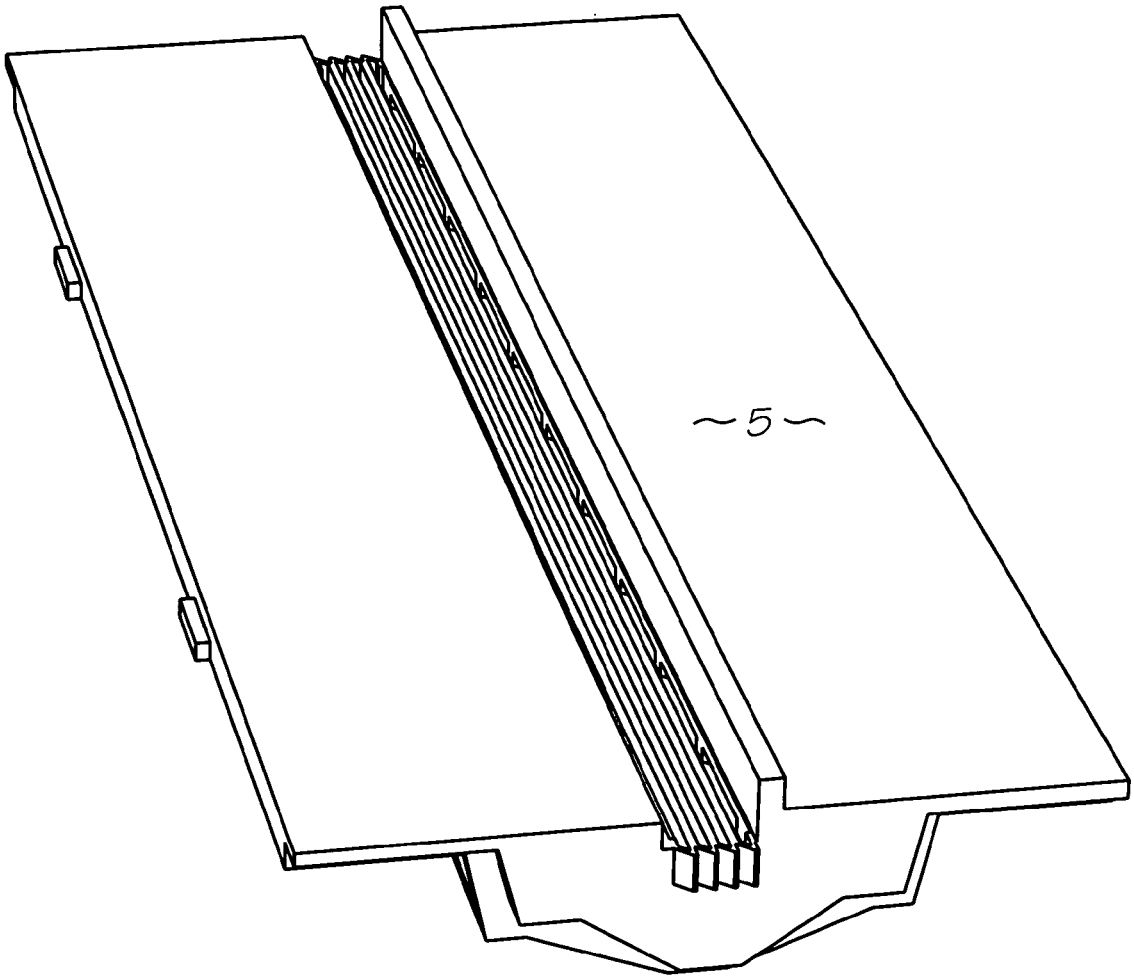
FIG. 9 shows a perspective view of the micro moulding that houses the printing chip in each printhead module.

Referring to FIGS. 7 to 9, the printhead modules (2) each comprise a printhead chip (8) bonded to a TAB (tape automated bond) film (6) accommodated and supported by a micro moulding (5), which is in turn adapted to mate with the cover moulding (4). The printhead chip (8) is typically a micro electro mechanical system(s) (MEMS) device.

The present invention will now be described with particular reference to the Applicant's MEMJET™ technology, various aspects of which are described in detail in the cross referenced documents. It will be appreciated that MEMJET™ is only one embodiment of the invention and used here for the purposes of illustration only. It is not to be construed as restrictive or limiting in any way on the extent of the broad inventive concept.

A MEMJET™ printhead is composed of a number of identical printhead modules (2) described in greater detail below. A MEMJET™ printhead is a drop-on-demand 1600 dpi inkjet printer that produces bi-level dots in up to 6 colors to produce a printed page of a particular width. Since the printhead prints dots at 1600 dpi (dots per inch), each dot is approximately 22.51 μm in diameter, and the dots are spaced 15.875 μm apart. Because the printing is bi-level, the input image is typically dithered or error-diffused for best results.

The modules (2) are designed such that the printhead chips (8) of adjacent modules can exactly abut one another so that there are no gaps or overlap in the printing produced. To achieve this, the modules (2) must be precisely aligned with each other after being mounted on the metal chassis (1).

Aligning the modules (2) using digital control of the chips (8) is possible but relatively difficult and costly given the complex manipulation of the print data necessary to seamlessly join the printing from adjacent modules. The required degree of alignment can be cost effectively provided by the mechanical adjustment mechanism of the present invention.

Figure 3:
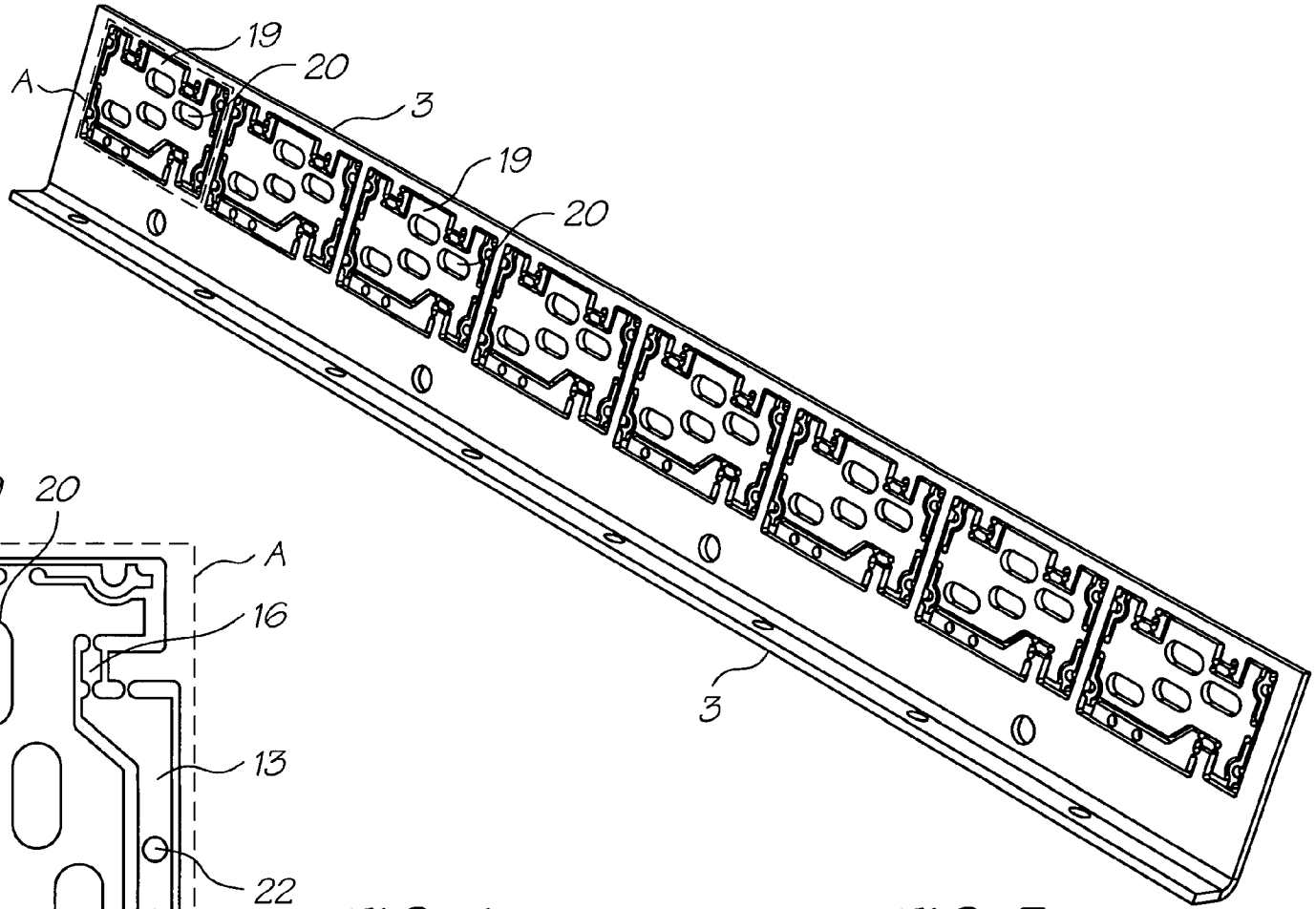
FIG. 3 is a perspective view of the support frame for the modular printhead shown in FIG. 1.
Figure 4:
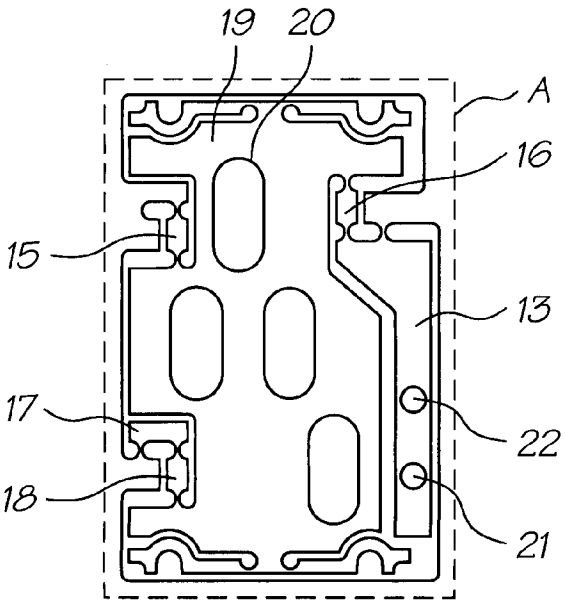
FIG. 4 is a plan view of the adjustment mechanism for one of the printhead modules shown in FIG. 1.
Figure 5:
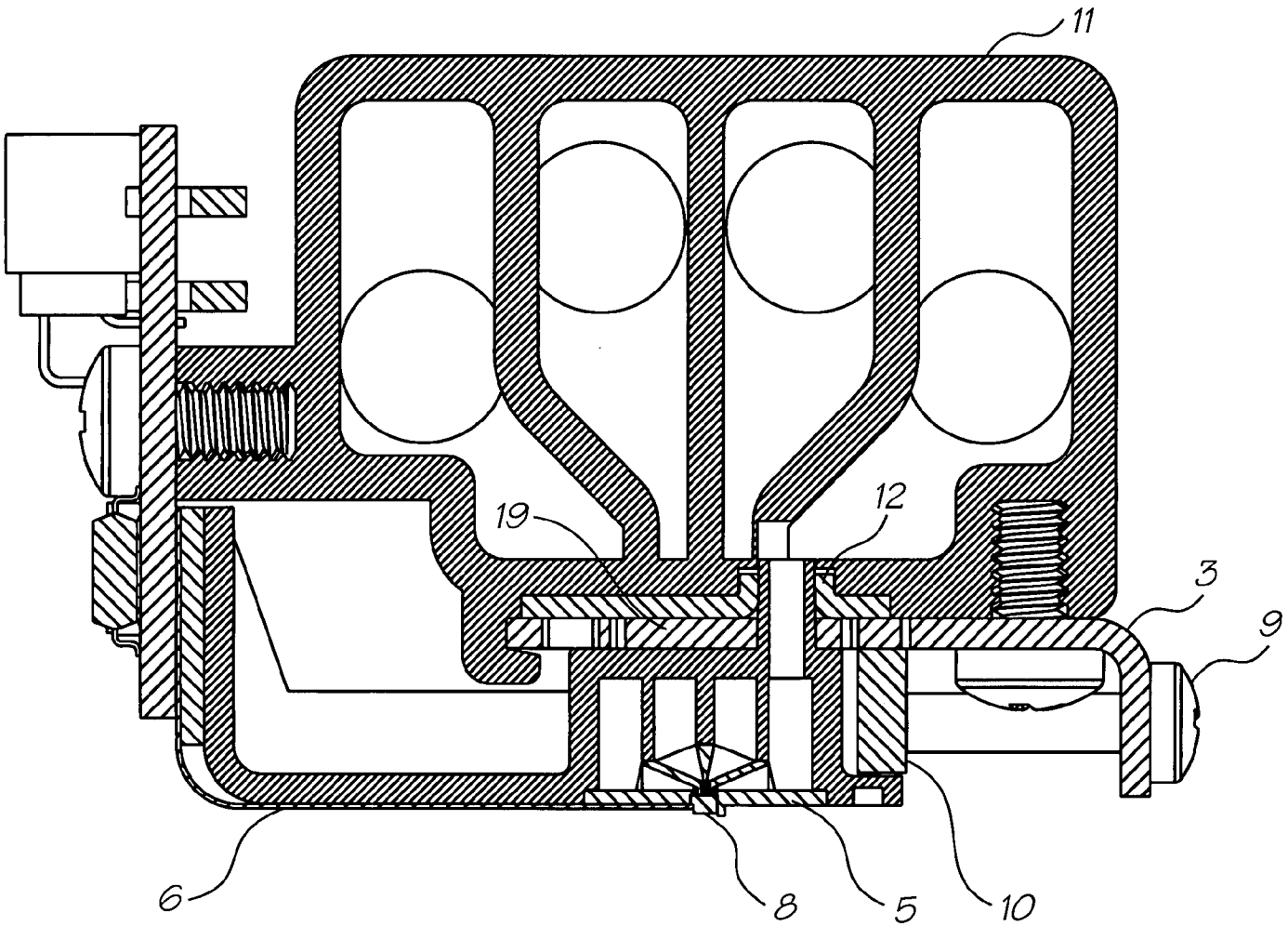
FIG. 5 is a cross-sectional view of the modular printhead shown in FIG. 1.
Figure 6:
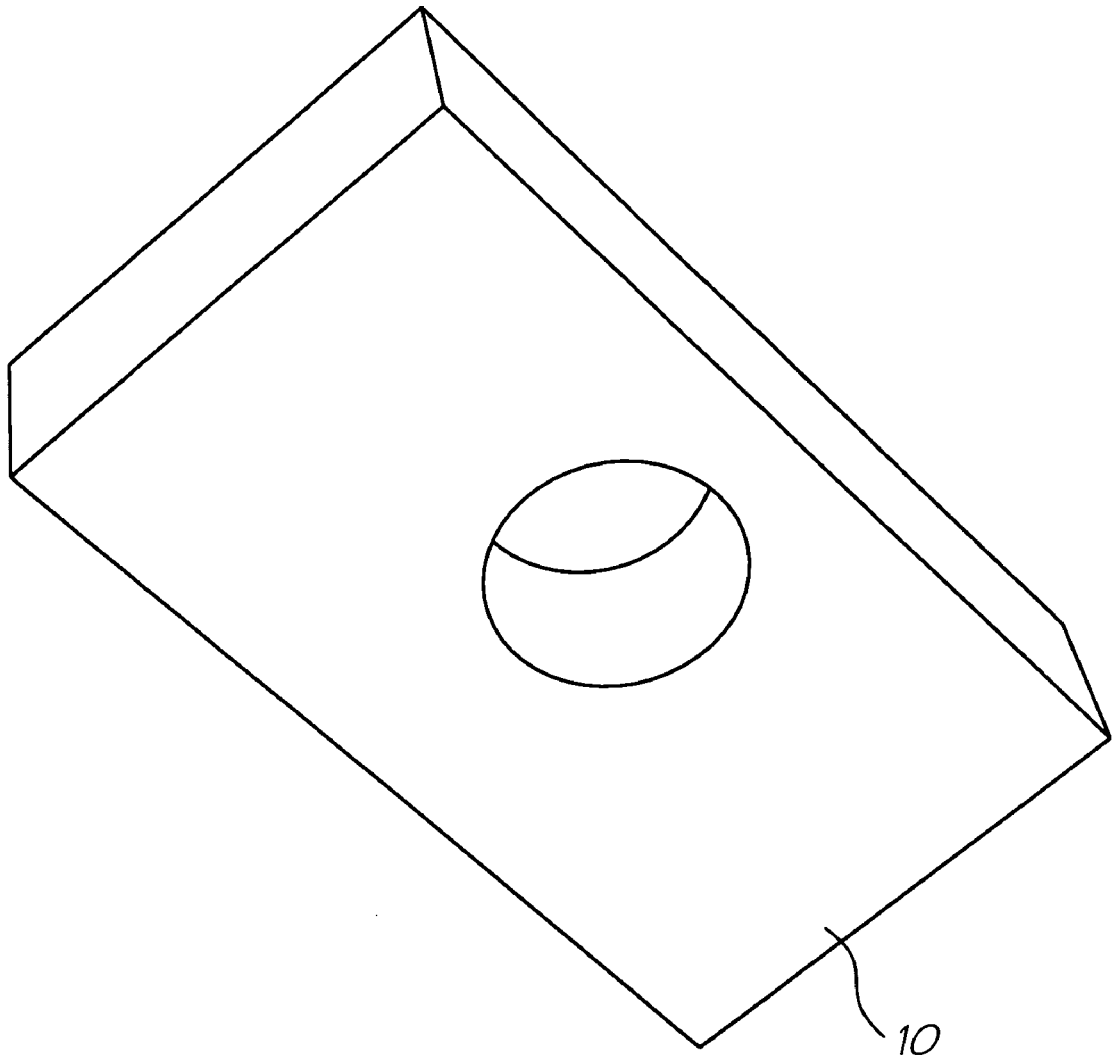
FIG. 6 is a perspective view of the adjuster block shown in FIG. 2.

Referring to FIGS. 3 and 4, the apertures (20) in the module engagement plate (19) receive the ink funnels for each module (2). The engagement plate (19) is integrally formed with the metal chassis (3) via hinged arms (15, 16, 17 & 18). Input lever (13) is fulcrumed against the metal chassis (3) to act on the engagement plate (19) via the hinged link arm (16). Movement of the input lever (13) is reduced by the lever arms to produce a minute movement of the engagement plate (19).

By careful configuration of the input lever (13) and the hinged link arms (15, 16, 17 & 18), the resultant movement in the engagement plate (19) is substantially linear and parallel to the longitudinal axis of the metal chassis (3). The skilled artisan will readily appreciate that it is convenient to configure the input lever (13) and the hinged link arms (15, 16, 17 & 18) such that input movement is substantially normal to the resultant movement for ease of access to the input lever (13). The apertures (21, 22) in each of the input levers (13) are used to fit any convenient intermediate integer (not shown) selected for applying the input force to their respective input lever (13).

Referring to FIG. 2, the intermediate integers chosen for the present embodiment are a series of adjuster blocks (10) individually fixed to each of the input levers. Grub screws (9) threadedly engaged with the metal chassis (3) to bear against each of the adjuster block (10).

This arrangement allows precise alignment of the modules (2) by reducing the axial input motion of the grub screw (9) by ratio of about 1000 to 1 to produce minute movement of the engagement plate (19) with respect to the metal chassis (3).

The invention has been described herein by way of example only. Skilled workers in this field will readily recognise many variations and modifications that do not depart from the spirit and scope of the broad inventive concept.

The invention claimed is:

1. A support for supporting a plurality of printhead modules for a printhead, the support comprising:

an elongate chassis;

a plurality of printhead module engagement arrangements located along the length of the chassis and for engaging with a respective printhead module; and a plurality of movement arrangements for each moving a respective engagement arrangement, and thereby the respective engaged printhead module, along the length of the chassis, each movement arrangement comprising a plurality of arms connecting the engagement arrangement to the chassis, and a lever fulcrumed against the chassis operable to move the engagement arrangement along the chassis.

2. A support as claimed in claim 1, wherein the elongate chassis comprises a metal plate.

3. A support as claimed in claim 1, wherein the chassis, printhead engagement arrangements and movement arrangements are integrally formed.

4. A support as claimed in claim 1, wherein each printhead module engagement arrangement comprises a plurality of apertures, each aperture being for receiving a respective ink funnel of a printhead module.

5. A support as claimed in claim 1, wherein each movement arrangement linearly moves a respective engagement arrangement along the chassis.

6. A printhead comprising a support as claimed in claim 1.

* * * * *